US011717040B2

(12) United States Patent
Craig

(10) Patent No.: US 11,717,040 B2
(45) Date of Patent: Aug. 8, 2023

(54) FOOTGEAR BARRIER AND FOOT COVERING INCORPORATING A FOOTGEAR BARRIER

(71) Applicant: Jeffrey D. Craig, Aurora, CO (US)

(72) Inventor: Jeffrey D. Craig, Aurora, CO (US)

(73) Assignee: Circle C Enterprises LLC, Aurora, CO (US)

( * ) Notice: Subject to any disclaimer, the term of this patent is extended or adjusted under 35 U.S.C. 154(b) by 21 days.

(21) Appl. No.: 17/497,234

(22) Filed: Oct. 8, 2021

(65) Prior Publication Data

US 2022/0369740 A1 Nov. 24, 2022

Related U.S. Application Data

(60) Provisional application No. 63/191,896, filed on May 21, 2021.

(51) Int. Cl.
*A41D 17/00* (2006.01)

(52) U.S. Cl.
CPC ..... *A41D 17/00* (2013.01)

(58) Field of Classification Search
CPC ..... A41D 17/00; A41D 17/005; A41D 17/02; A43B 3/166; A43B 7/20
USPC ..... 36/1.5, 2 r, 89
See application file for complete search history.

(56) References Cited

U.S. PATENT DOCUMENTS 1,478,468 A * 12/1923 Binns ..... A43B 3/02 36/1
1,572,313 A * 2/1926 Sarar ..... A41D 17/00 36/70 R
1,573,299 A * 2/1926 Bullock ..... A43B 5/10 36/114
2,547,424 A * 4/1951 Williams ..... A41D 17/02 24/72.1
4,559,722 A * 12/1985 Norton ..... A43B 5/06 36/105
4,856,209 A * 8/1989 Kenyon ..... A43B 7/20 36/114
5,070,630 A * 12/1991 Edmundson ..... A43B 3/00 D24/190
5,428,975 A 7/1995 Lee, III et al.
6,094,745 A * 8/2000 Fulton ..... A41D 17/00 2/242
6,189,172 B1 * 2/2001 Baek ..... A43B 5/0407 36/117.6
6,354,114 B1 3/2002 Sghiatti
6,651,257 B2 11/2003 Smith
7,937,852 B1 5/2011 Krehbiel
(Continued)

OTHER PUBLICATIONS

FlexFoam-iT! Series, Flexible Polyurethane Foams, Smooth-On, 2 pages, www.smooth-on-com, as filed on Oct. 8, 2021.

*Primary Examiner* — Ted Kavanaugh

(74) *Attorney, Agent, or Firm* — David F. Dockery; The Navitas Intellectual Property Group LLC

(57) ABSTRACT

A footgear barrier and a foot covering incorporating a footgear barrier. The footgear barrier is sized and shaped to be placed around a user's ankle and over the footgear, such as an athletic shoe, to block the gaps between the user's ankle and the footwear and reduce the amount of debris that may pass through the gaps. The footgear barrier may be incorporated within a foot cover such as a sock, such that the barrier is secured within an upper portion of the sock.

13 Claims, 5 Drawing Sheets

(56) References Cited

U.S. PATENT DOCUMENTS

| | | | | |
|---|---|---|---|---|
| 2007/0101616 | A1* | 5/2007 | Munns | A43B 5/145 36/131 |
| 2012/0174442 | A1 | 7/2012 | Castle | |
| 2017/0086530 | A1* | 3/2017 | Locker | A43B 1/0018 |

* cited by examiner

FOOTGEAR BARRIER AND FOOT COVERING INCORPORATING A FOOTGEAR BARRIER

CROSS-REFERENCE TO RELATED APPLICATIONS

This application claims the priority benefit of U.S. Provisional Patent Application No. 63/191,896 by Craig and filed on May 21, 2021, which is incorporated herein by reference in its entirety.

BACKGROUND

A common problem encountered by people who participate in outdoor activities such as running, hiking, biking etc. is that debris (e.g., dirt, gravel, etc.) may enter the user's footgear (athletic shoes, hiking boots, etc.), particularly when traversing natural trails or gravel roads. It is known to use gaiters to prevent such problems, however gaiters are cumbersome to use and not aesthetically pleasing, particularly when used with running shoes, including trail running shoes, and other low cut (e.g., low profile) footgear.

SUMMARY

The present disclosure relates to a footgear barrier that is configured to be placed around a user's ankle and over the foot-receiving opening (e.g., the collar) of the footgear (e.g., an athletic shoe) to block the gaps between the user's ankle and the footwear and reduce the amount of debris that may pass through the gaps. The footgear barrier may be used alone or in combination with a foot cover (e.g., a sock), e.g., where the barrier is secured within an upper portion of the sock.

In one embodiment, the footgear barrier comprises a heel portion having a heel notch configured to surround an Achilles tendon of a user and a bridge portion, opposite the heel portion, that is configured to lie over the talus bone of the user when the heel notch surrounds the Achilles tendon of the user. A first sidewall is disposed between the heel portion and the bridge portion and a second sidewall, opposite the first sidewall, is disposed between the heel portion and the bridge portion, where each of the first and second sidewalls has a substantially concave shape. An opening through the footgear barrier is defined by the heel portion, bridge portion, first sidewall and second sidewall, and is configured to receive the user's foot through the opening, i.e., so that the footgear barrier may be operatively placed around a user's ankle.

The foregoing footgear barrier may be characterized as having different refinements and/or additional features, which may be employed alone or in any combination. In one refinement, the footgear barrier is fabricated from a flexible material. For example, the flexible material may be selected from the group consisting of silicone, polymeric foam and elastomers. In another refinement, the footgear barrier is formed from a single, unitary body.

In another refinement, the footgear barrier has a barrier width and a barrier length, where the barrier length is greater than the barrier width. In another refinement, the heel notch has a heel notch width and a heel notch length, where the heel notch length is greater than the heel notch width. In another refinement, the heel notch includes a gap that is contiguous with the footgear opening and wherein the gap is narrower than the heel notch width.

In another refinement, the first sidewall and the second sidewall comprise a substantially concave upper edge. In one implementation of this refinement, the first sidewall and the second sidewall comprise a substantially convex lower edge.

In one construction, the footgear barrier also includes a skirt portion that extends downwardly from at least the first and second sidewalls.

In another embodiment, a foot covering is disclosed that incorporates a footgear barrier. The foot covering includes a closed end configured to be disposed proximate a user's toes and an open end opposite the closed end and configured to encircle the user's leg above the user's footgear when the foot covering is placed over the user's foot. A flexible footgear barrier disposed within the open end of the foot covering, the footgear barrier comprising a heel portion configured to surround an Achilles tendon of a user and a bridge portion opposite the heel portion and configured to lie over the talus bone of the user when the heel portion surrounds the Achilles tendon of the user. A first sidewall is disposed between the heel portion and the bridge portion and a second sidewall, opposite the first sidewall, is disposed between the heel portion and the bridge portion. An opening through the footgear barrier is defined by the heel portion, bridge portion, first sidewall and second sidewall, and that is configured to receive the user's foot through the opening.

DESCRIPTION

FIGS. 1-5 illustrate several views of a footgear barrier according to an embodiment of the present disclosure. The footgear barrier 100 is configured (e.g., sized and shaped) to be placed over a user's foot, e.g., to reduce the debris (e.g., dirt, gravel, etc.) that may enter the footgear due to gaps between the footgear and the user's foot. As used herein, the term footgear includes, but is not limited to, shoes, athletic shoes such as road running shoes or trail runners, cleats, boots such as hiking boots, bike shoes and the like.

The footgear barrier 100 may be fabricated from a variety of materials. In one embodiment, the footgear barrier comprises (e.g., is fabricated from) a flexible material. As used herein, a flexible material is one that is readily bent or otherwise deformed without breaking and without losing its original shape, e.g., a material that is elastic and pliant. Examples of useful flexible materials include, but are not limited to, silicone, polymeric foams and elastomers such as rubber. In one implementation, the footgear barrier is fabricated from a polymeric foam such as a water blown flexible polyurethane foam. In one characterization, the polymer foam has a specific gravity (ASTM D-1475) of at least about 0.08 g/cc, such as at least about 0.11 g/cc and not greater than about 0.22 g/cc, such as not greater than about 0.16 g/cc. In another characterization, the polymeric foam has a specific volume of at least about 114 $in^3$/lb (4.37 cc/g), such as at least about 157 $in^3$/lb (5.67 cc/g), and not greater than about 280 $in^3$/lb (10.11 cc/g), such as not greater than about 229 $in^3$/lb (8.27 cc/g). One example of such polymer foam is the water blown polymer foam sold under the tradename FlexFoam-iT! VIII (Smooth-On, Inc., Macungie, Pa., USA). The use of such a flexible material enables the barrier to conform to the user's foot and the underlying footgear, e.g., forming a light seal therebetween. A flexible material also does not cause discomfort for the user.

In one embodiment, the footgear barrier may be characterized as including a heel portion, a bridge portion and first and second sidewalls disposed between the heel portion and bridge portion, with an opening therethrough, e.g., through which a user's foot may be inserted to place the footgear barrier around the user's ankle.

Figure 1:
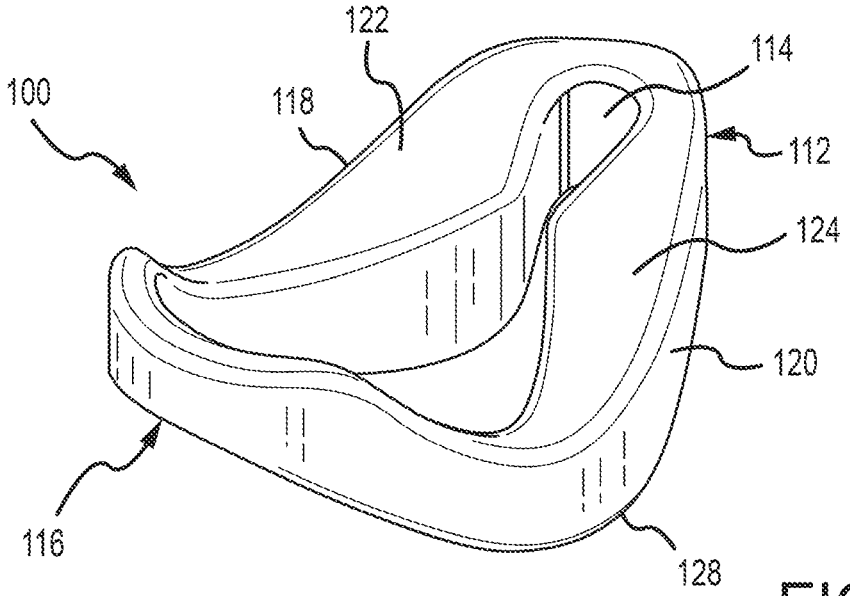
FIG. 1 illustrates a perspective view of a footgear barrier according to an embodiment of the present disclosure.
Figure 2:
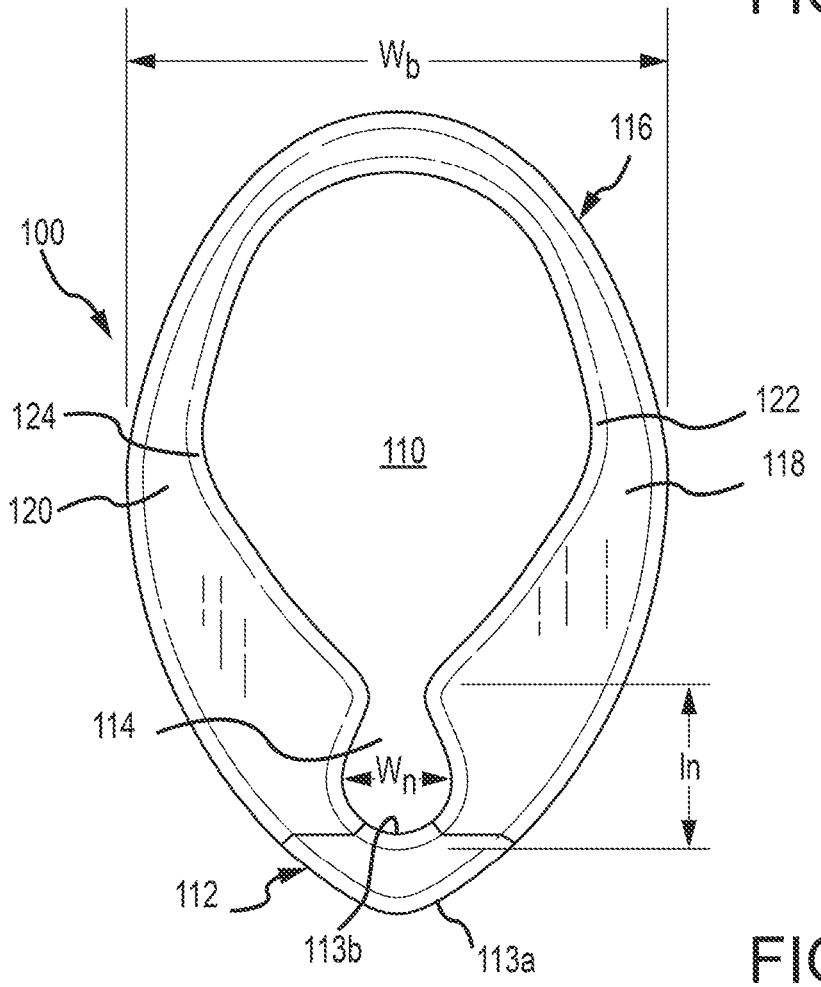
FIG. 2 illustrates a top view of the footgear barrier illustrated in FIG. 1.
Figure 3:
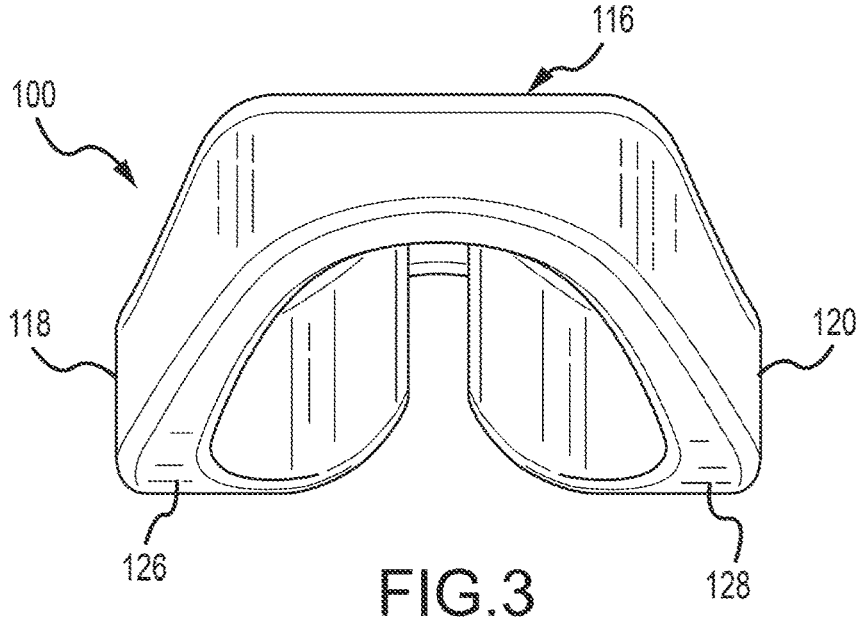
FIG. 3 illustrates a front view of the footgear barrier illustrated in FIG. 1.

Referring to FIGS. 1-5, the footgear barrier 100 includes a heel portion 112 that may be defined as being a rearward portion with respect to the orientation of the barrier 100 in use. The heel portion 112 includes an outer edge 113*a* and an inner edge 113*b*. The outer edge 113*a* is generally curved, e.g., non-linear, so that the outer edge 113*a* of the heel portion generally conforms to the shape of the rear edge of the footgear, e.g., the rear edge of the footgear' collar. An inner edge 113*b* defines a heel notch 114 that is configured to surround an Achilles tendon of a user when the footgear barrier 100 is operatively placed around the user's ankle. That is, the heel notch 114 is configured to snugly fit around the Achilles tendon to inhibit debris from entering the footgear. For example, the heel notch 114 may be characterized as having a keyhole shape, e.g., having a narrow gap contiguous with the opening 110 in the front of the heel notch through which the Achilles tendon passes to be enclosed by the semi-circular rear portion of the heel notch. In another characterization, the heel notch 114 has a heel notch width ($w_n$) and a heel notch length ($l_n$) as best illustrated in FIG. 2, where the heel notch length is greater than the heel notch width.

A bridge portion 116 lies opposite the heel portion 112, e.g., at the front of the footgear barrier in use, and is configured (e.g., sized and shaped) to lie over the talus bone of the user when the heel notch 114 surrounds the Achilles tendon of the user, i.e., when the footgear barrier 100 is operatively placed around the user's ankle. Stated another way, the bridge portion is configured to lie proximate the tongue of the footgear. The bridge portion 116 includes an outer edge 117*a* and an inner edge 117*b*. The outer edge 117*a* and the inner edge 117*b* are generally curved and as illustrated in FIGS. 1-5, the two edges form substantially symmetric (e.g., parallel) curves, in contrast to the non-symmetric edges 113*a*/113*b* of the heel portion.

A first sidewall 118 is disposed between the heel portion and the bridge portion, e.g., on the right side of the footgear barrier 100 when the footgear barrier is operatively placed on a user's ankle. A second sidewall 120 is disposed opposite the first sidewall 118, e.g., across the opening 110 and extends between the heel portion 112 and the bridge portion 116 along the right side of the footgear barrier 100 when the footgear barrier is operatively placed on a user's ankle. The sidewalls 118/120 have contoured upper edge surfaces 122/124, e.g., having substantially concave shape. In this manner, the sidewalls 118/120 may be positioned rest below the lateral malleolus and the medial malleolus of the user so that the barrier 100 does not rub against them. Likewise, the lower sidewall edges 126/128 may also be contoured, e.g., convex, to form substantially symmetric (e.g., parallel) curves with the upper edges 122/124.

An opening 110 is defined through the footgear barrier, i.e., an opening defined by the construction of the heel portion, bridge portion, first sidewall and second sidewall. The opening 110 is configured (e.g., sized and shaped) to receive the user's foot through the opening so that the user may slide the barrier 100 over the user's foot and onto the user's ankle.

Figure 4:
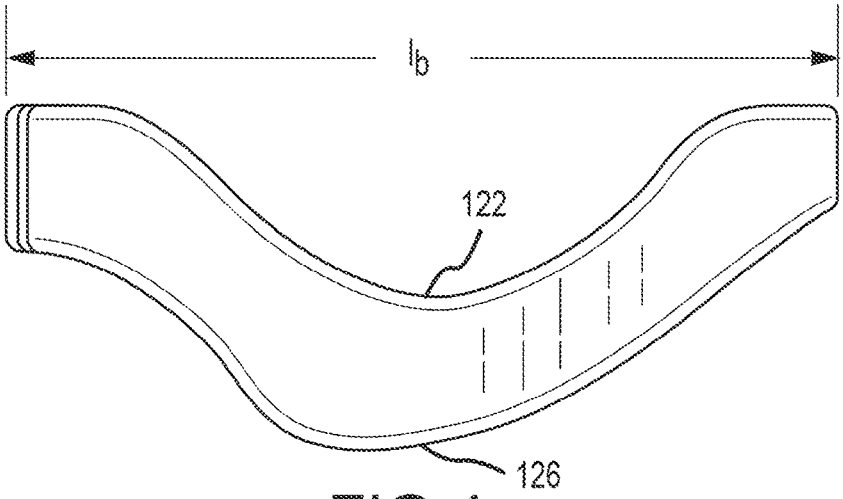
FIG. 4 illustrates a side view of the footgear barrier illustrated in FIG. 1.
Figure 5:
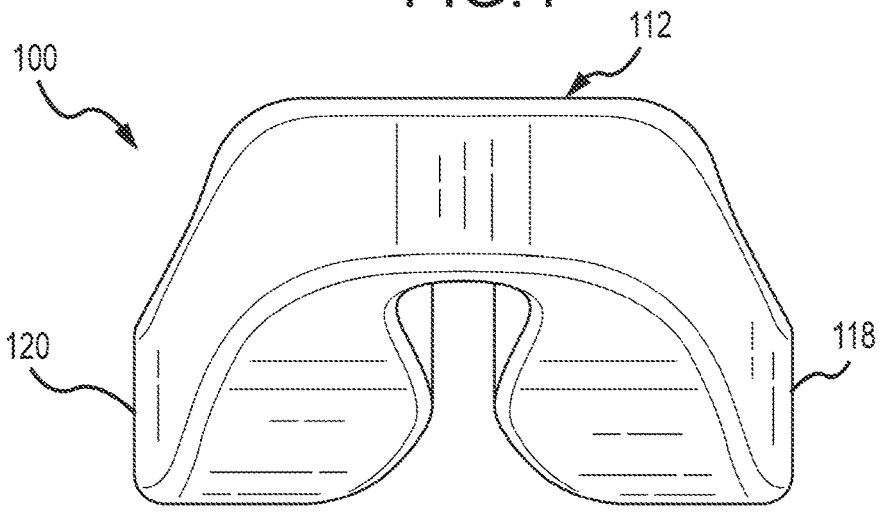
FIG. 5 illustrates a rear view of the footgear barrier illustrated in FIG. 1.

As noted above, the footgear barrier 100 is sized and shaped to readily fit around a user's ankle and obstruct the gaps between the user's ankle and the footgear. The footgear barrier 100 has a barrier length ($l_b$), i.e., along a longitudinal axis of the barrier as best illustrated in FIG. 4 and a barrier width ($w_b$) as best illustrated in FIG. 2. In one characterization, the footgear barrier length is greater than the footgear barrier width. For example, the barrier length may be at least about 33% greater than the barrier width, such as at least about 40% greater than the barrier width or even at least about 45% greater than the barrier width. Further, the barrier length may be not greater than about 66% of the barrier width, such as not greater than about 60% of the barrier width or even not greater than about 55% of the barrier width. In one implementation, the footgear barrier 100 has a barrier length that is at least about 45% and not greater than about 55% of the barrier width.

Although the footgear barrier 100 is illustrated as being substantially symmetric about its longitudinal axis, it will be appreciated that the barrier may be asymmetric about the longitudinal axis, e.g., where the contours of the sidewalls 118/120 are not identical. Such asymmetry may provide a better fit and improved debris blocking due to differences in the lateral malleolus and the medial malleolus of the user.

Figure 6:
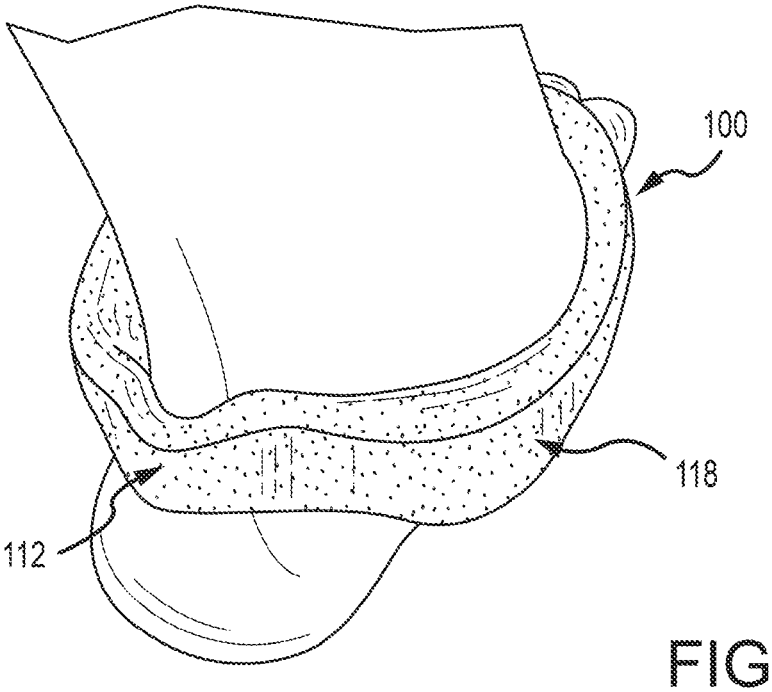
FIG. 6 illustrates a footgear barrier according to an embodiment of the present disclosure that is placed over a user's foot.
Figure 7:
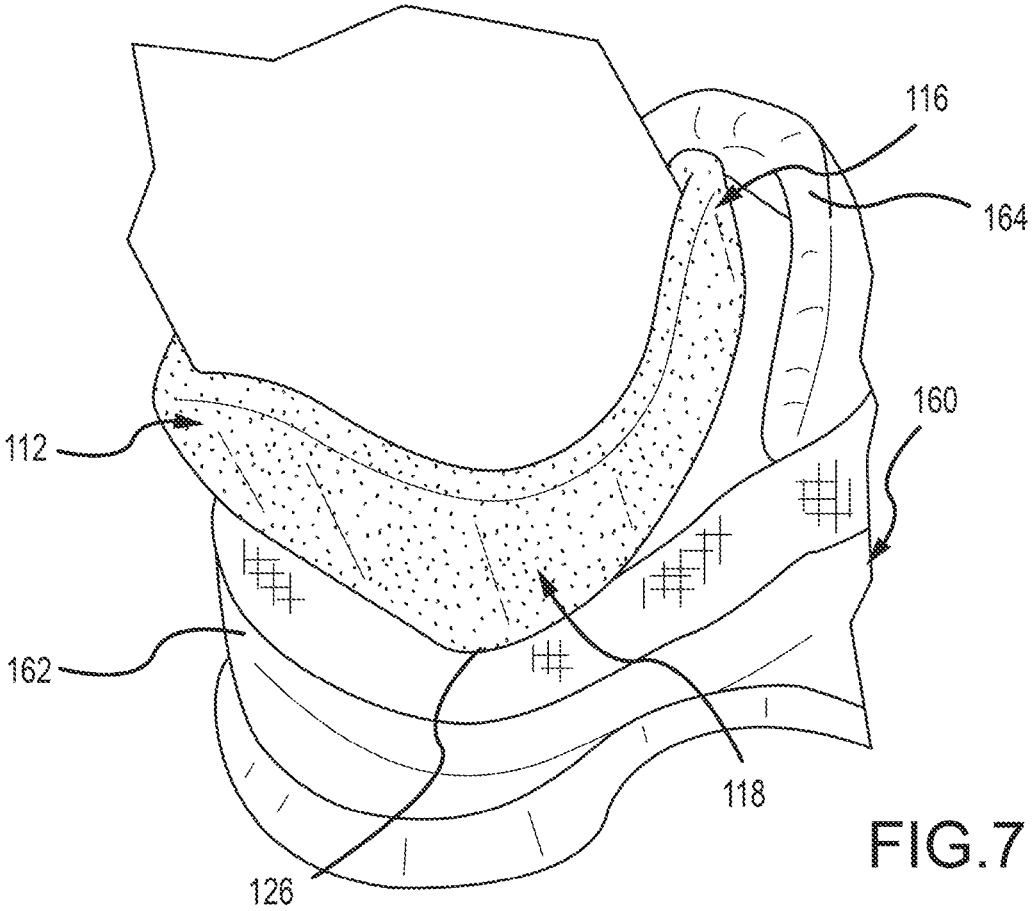
FIG. 7 illustrates the footgear barrier of FIG. 6 that is placed over a user's foot in combination with an athletic shoe.

FIGS. 6 and 7 illustrate the footgear barrier 100 of FIGS. 1-5 disposed around the ankle of a user. As can be seen in FIGS. 6 and 7, the shape of the heel portion 112 combined with the flexible (e.g., elastic) nature of the footgear barrier 100 form a tight seal around the user's Achilles tendon. Likewise, the sidewalls (e.g., sidewall 118) form a seal along the side of the user's ankle, i.e., just on or below the lateral malleolus and the medial malleolus of the user. As shown in FIG. 7, the bridge portion 116 is positioned against the tongue 164 of the footgear 160 to inhibit debris from entering the footgear 160 under the tongue 164. It can also be seen that the footgear barrier rests upon the footgear collar 162 along the rear heel portion 112 and the sidewall 118 of the footgear barrier 100.

Figure 8:
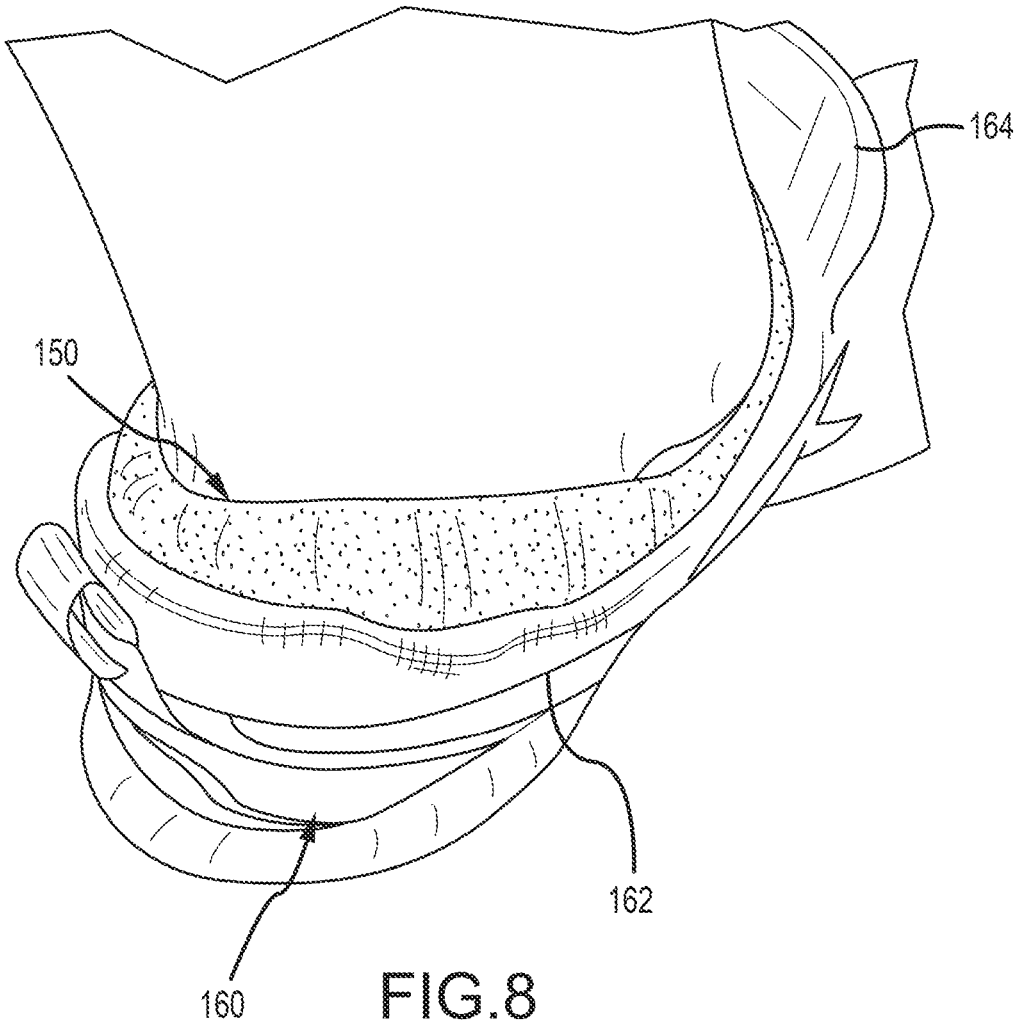
FIG. 8 illustrates an athletic sock incorporating a footgear barrier according to an embodiment of the present disclosure.

The present disclosure is also directed to a foot covering that incorporates a footgear barrier that is configured to inhibit debris from entering the footgear. As used herein, the term foot covering includes socks such as athletic socks, tube socks and the like. The foot covering may be characterized as including a closed end configured to be disposed proximate a user's toes and an open end opposite the closed end that is configured to encircle the user's leg above the user's footgear when the foot covering is placed over the user's foot. As illustrated in FIG. 8, the foot covering 150 incorporating the barrier inhibits debris from entering the footgear 160, e.g., under the footgear collar 162 or under the footgear tongue 164. The barrier also prevents the foot covering 150 from sliding into the footgear 160 during use. FIG. 8 also illustrates that the barrier within the foot covering 150 lies in close proximity to the athletic shoe (e.g., a running shoe having a low cut) to enhance the aesthetics, e.g., as compared to a gaiter or similar debris blocking device. In one characterization, the barrier is sewn within the foot covering, although other techniques of securing the barrier within the foot covering may be used.

Figure 9B:
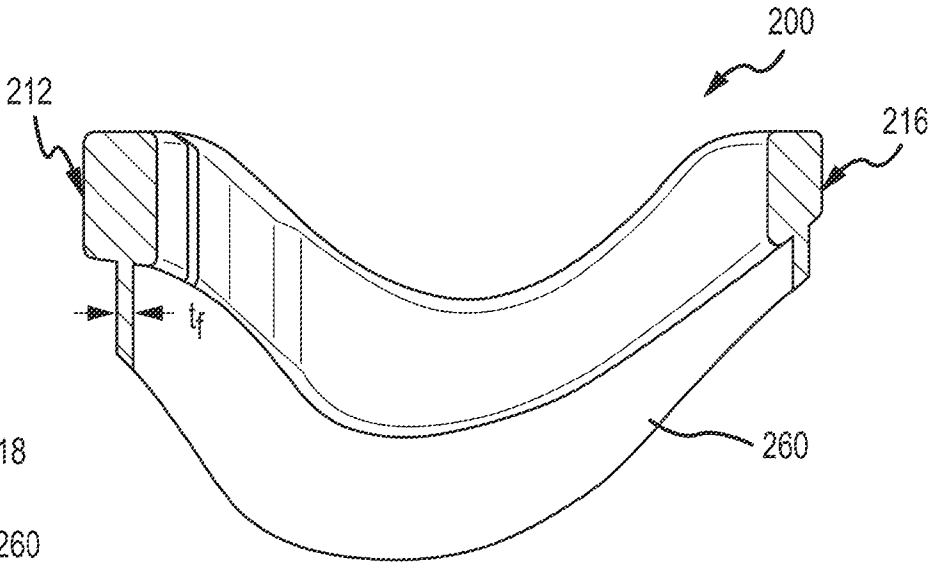
FIGS. 9A and 9B illustrate a footgear barrier having a lower flap according to another embodiment of the present disclosure.
Figure 9A:
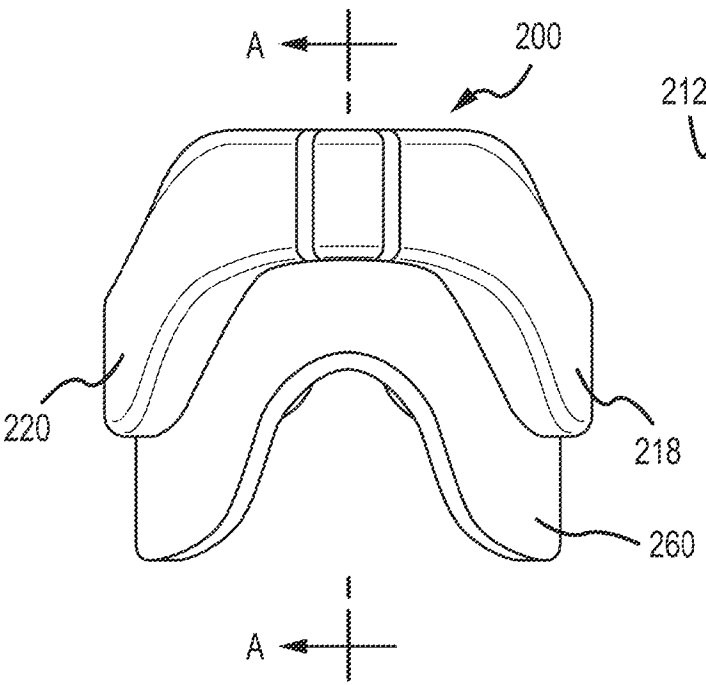

In a further embodiment, the footgear barrier comprises a lower flap that is configured to fit between the user's foot and the interior of the footgear during use. FIGS. 9A and 9B illustrate such an embodiment, where FIG. 9A illustrates a rear view of the footgear barrier 200 and FIG. 9B illustrates a cross-section of the footgear barrier 200 taken along plane A-A of FIG. 9A. Similar to the footgear barrier illustrated in FIGS. 1-5, the footgear barrier 200 is comprised of a heel portion 212, a bridge portion 216 and sidewalls 218 and 220. A lower flap 260 extends downwardly from each portion of the footgear barrier, e.g., extends downwardly from the heel portion 212, the bridge portion 216 and the sidewalls 218 and 220. The flap 260 has a thickness that enables the flap to comfortably between the user's foot and the interior of the footgear. For example, the thickness of the flap ($t_f$) may be not greater than about 25 mm, such as not greater than about 20 mm. In another characterization, the flap 260 has a thickness that is less than the thickness of the heel portion 212 and the bridge portion 216. The implementation of a lower flap 260 enables the footgear barrier 200 to be held in place during use, e.g., without the use of a foot cover.

As disclosed herein, the footgear barrier offers a number of advantages as compared to similarly purposed devices. The footgear barrier is specifically contoured to inhibit the passage of debris into the footwear, is comfortable for the user and does not present aesthetic issues. When used within a foot covering, the footgear barrier also keeps the foot covering in place, eliminating the possibility of the foot covering from gathering below the intended contour of the top of the foot gear. When combined with a foot covering, the foot gear barrier also provides stability to the wearer enhancing comfort and reducing the possibility of irritation, e.g., reducing the formation of blisters.

Although illustrated and described above as comprising a single, unitary body, the footgear barrier may be comprised of two or more individual components that may be combined to function in a similar manner. For example, the barrier may include a first component comprising the heel portion and a second component comprising the bridge portion, where the two components may be operatively joined to form the barrier.

While various embodiments of a footgear barrier and a foot covering have been described in detail, it is apparent that modifications and adaptations of those embodiments will occur to those skilled in the art. However, is to be expressly understood that such modifications and adaptations are within the spirit and scope of the present disclosure.

What is claimed is:

1. A footgear barrier, comprising:

a heel portion comprising a heel notch configured to surround an Achilles tendon of a user;

a bridge portion opposite the heel portion and configured to lie over the talus bone of the user when the heel notch surrounds the Achilles tendon of the user;

a first sidewall disposed between the heel portion and the bridge portion;

a second sidewall, opposite the first sidewall, disposed between the heel portion and the bridge portion, the first and second sidewalls having a substantially concave shape; and an opening through the footgear barrier that is defined by the heel portion, bridge portion, first sidewall and second sidewall, and that is configured to receive the user's foot through the opening; and the heel notch comprises a gap that is contiguous with the footgear opening and wherein the gap is narrower than the heel notch width.

2. The footgear barrier recited in claim 1, wherein the footgear barrier is fabricated from a flexible material.

3. The footgear barrier recited in claim 2, wherein the flexible material is selected from the group consisting of silicone, polymeric foam and elastomers.

4. The footgear barrier recited in claim 2, wherein the flexible material is a polymeric foam.

5. The footgear barrier recited in claim 2, wherein the flexible material has a specific gravity of at least about 0.08 g/cc and not greater than about 0.22 g/cc.

6. The footgear barrier recited in claim 2, wherein the flexible material has a specific volume of at least about 114 $in^3$/lb and not greater than 280 $in^3$/lb.

7. The footgear barrier recited in claim 1, wherein the footgear barrier has a barrier width ($w_b$) and a barrier length ($l_b$), where the barrier length is greater than the barrier width.

8. The footgear barrier recited in claim 1, wherein the heel notch has a heel notch width ($w_n$) and a heel notch length ($l_n$), where the heel notch length is greater than the heel notch width.

9. The footgear barrier recited in claim 1, wherein the first sidewall and the second sidewall comprise a substantially concave upper edge.

10. The footgear barrier recited in claim 9, wherein the first sidewall and the second sidewall comprise a substantially convex lower edge.

11. The footgear barrier recited in claim 1, wherein the footgear barrier is substantially symmetrical relative to its longitudinal axis.

12. The footgear barrier recited in claim 1, further comprising a lower flap extending downwardly from at least the first sidewall and the second sidewall.

13. The footgear barrier recited in claim 12, wherein the lower flap has a thickness that is less than a thickness of the first sidewall and the second sidewall.

* * * * *